US006621402B2

(12) United States Patent
Huang

(10) Patent No.: US 6,621,402 B2
(45) Date of Patent: Sep. 16, 2003

(54) CIRCUIT BREAKER

(76) Inventor: Albert Huang, 3F, No. 146, Sec. 4, Chungking S. Rd., Taipei (TW)

( * ) Notice: Subject to any disclaimer, the term of this patent is extended or adjusted under 35 U.S.C. 154(b) by 11 days.

(21) Appl. No.: 10/052,499

(22) Filed: Jan. 23, 2002

(65) Prior Publication Data

US 2003/0137390 A1 Jul. 24, 2003

(51) Int. Cl.[7] ..... H01H 37/02; H01H 37/32; H01H 71/16

(52) U.S. Cl. ..... 337/66; 337/72; 337/89; 337/111; 337/37

(58) Field of Search ..... 337/59, 37, 39, 337/1, 3, 12–19, 16, 36, 53, 62, 66, 75, 72, 85, 89, 101, 111, 112, 113; 200/339, 341

(56) References Cited

U.S. PATENT DOCUMENTS

| | | | | | |
|---|---|---|---|---|---|
| 2,255,330 | A | * | 9/1941 | Platz | 337/91 |
| 2,297,320 | A | * | 9/1942 | Platz | 337/60 |
| 3,562,689 | A | * | 2/1971 | Bar | 337/77 |
| 4,345,233 | A | * | 8/1982 | Matthies | 337/75 |
| 4,363,016 | A | * | 12/1982 | Unger | 337/56 |
| 4,371,859 | A | * | 2/1983 | Sorimachi | 337/365 |
| 4,528,538 | A | * | 7/1985 | Andersen | 337/43 |
| 4,833,439 | A | * | 5/1989 | Bowden et al. | 337/68 |
| 4,868,535 | A | * | 9/1989 | Janniere et al. | 337/68 |
| 5,248,954 | A | * | 9/1993 | Chiang | 337/66 |
| 5,453,725 | A | * | 9/1995 | You et al. | 337/68 |
| 5,541,569 | A | * | 7/1996 | Jang | 337/68 |
| 5,742,219 | A | * | 4/1998 | Moalem et al. | 337/68 |
| 5,760,672 | A | * | 6/1998 | Wang | 337/79 |
| 5,828,284 | A | * | 10/1998 | Huang | 337/37 |
| 5,898,355 | A | * | 4/1999 | Yu | 337/8 |
| 6,400,250 | B1 | * | 6/2002 | Wang | 337/66 |

FOREIGN PATENT DOCUMENTS

| | | | | |
|---|---|---|---|---|
| CH | 647094 A5 | * | 12/1984 | H01H/71/16 |
| WO | WO 8704561 A1 | * | 7/1987 | H01H/71/16 |

* cited by examiner

*Primary Examiner*—Anatoly Vortman
(74) *Attorney, Agent, or Firm*—Bacon & Thomas, PLLC

(57) ABSTRACT

A circuit breaker includes a housing having a rim defining an open top and having a closed bottom defining two slots. A button is pivotally connected to the housing at the open top and is pivotal relative to the housing between two extreme positions. A first blade and a second blade extend from the interior to the exterior of the housing through the slots. A bimetallic strip is held in place in the housing and engaged with the second blade. The bimetallic strip has a U-shaped groove surrounding a tongue portion of the bimetallic strip. The tongue portion is normally engaged with the first blade. Additionally, the button has two legs configured so that the tongue portion of the bimetallic strip may be sandwiched between the legs whenever the button is in any angular position between the two extreme positions.

2 Claims, 3 Drawing Sheets

CIRCUIT BREAKER

BACKGROUND OF THE INVENTION

1. Field of the Invention

The present invention relates to a circuit breaker and, more particularly, to a circuit breaker which is simple in structure and easy to be assembled.

2. Description of Related Art

There are various types of circuit breakers. As shown in FIG. 4, one of them includes a hollow body (40) having an open top and a closed bottom, with the closed bottom defining three slots (41, 42, 43) through which a grounding prong (44), an output blade (45) and an input blade (46) extend downward out of the hollow body (40), respectively.

As clearly shown, the output blade (45) has a bent inner end provided with a first contact (451), while the input blade (46) has a bent inner end formed with a laterally extending bimetallic strip (48) that is provided with a second contact (481) normally engaged with the first contact (451) of the output blade. (45).

At the open top of the hollow body (40), there is a button (50) pivotal about an axle (51). The button (50) is formed with a pair of opposed sidewalls (52), one behind another, and with a leg (60) having a pair of opposed upper lugs (62) situated between and pivotally connected to the sidewalls (52) by a pintle (53). Also pivotally connected to the sidewalls (52) by the same pintle (53) is a hook (65) that has a lower arm beneath the bimetallic strip (48).

The leg (60) further has a boss (61) slidable into a semi-circular recess (49) defined in an inner wall of the hollow body (40), and a first protrusion (601) opposed to the boss (61). The hollow body (40) defines therein a compartment (491) for receiving a holder (64) that has a second protrusion (641) opposite to the first protrusion (601) of the leg (60).

It is between the protrusions (601, 641) that a spring (63) is compressed so as to press the boss (61) of the pivotal leg (60) against the inner wall of the body (40).

Referring to FIG. 5, the bimetallic strip (48) becomes hot and curved upward if an electric overcurrent goes through it as well as the blades (45, 46). The bimetallic strip (48) now pushes the leg (60) upward and hence turns the button (50) in a clockwise direction until the boss (61) of the pivotal leg (60) slides into the semi-circular recess (49) of the body (40) by the action of the compressed spring (63).

From then on, the bimetallic strip (48) is retained in this position by the lower arm of the hook (65) and the contacts (481, 45) are disengaged from each other, unless the button (50) is manually turned counterclockwise again.

It is apparent that this conventional circuit breaker is excessively complex in its structure as it has so many parts to be fabricated.

Furthermore, the hollow body (40) is designed to be covered with a front cover (not shown), which is riveted to the body (40) at several sleeves (47) of the body (40). The manual riveting makes the circuit breaker difficult to be assembled.

Therefore, it is an objective of the invention to provide a circuit breaker to mitigate and/or obviate the aforementioned problems.

SUMMARY OF THE INVENTION

The object of the present invention is to provide a circuit breaker which is simple in structure.

Another object of the present invention is to provide a circuit breaker which is easy to be assembled.

Other objects, advantages and novel features of the invention will become more apparent from the following detailed description when taken in conjunction with the accompanying drawings.

DETAILED DESCRIPTION OF THE PREFERRED EMBODIMENT

Figure 1:
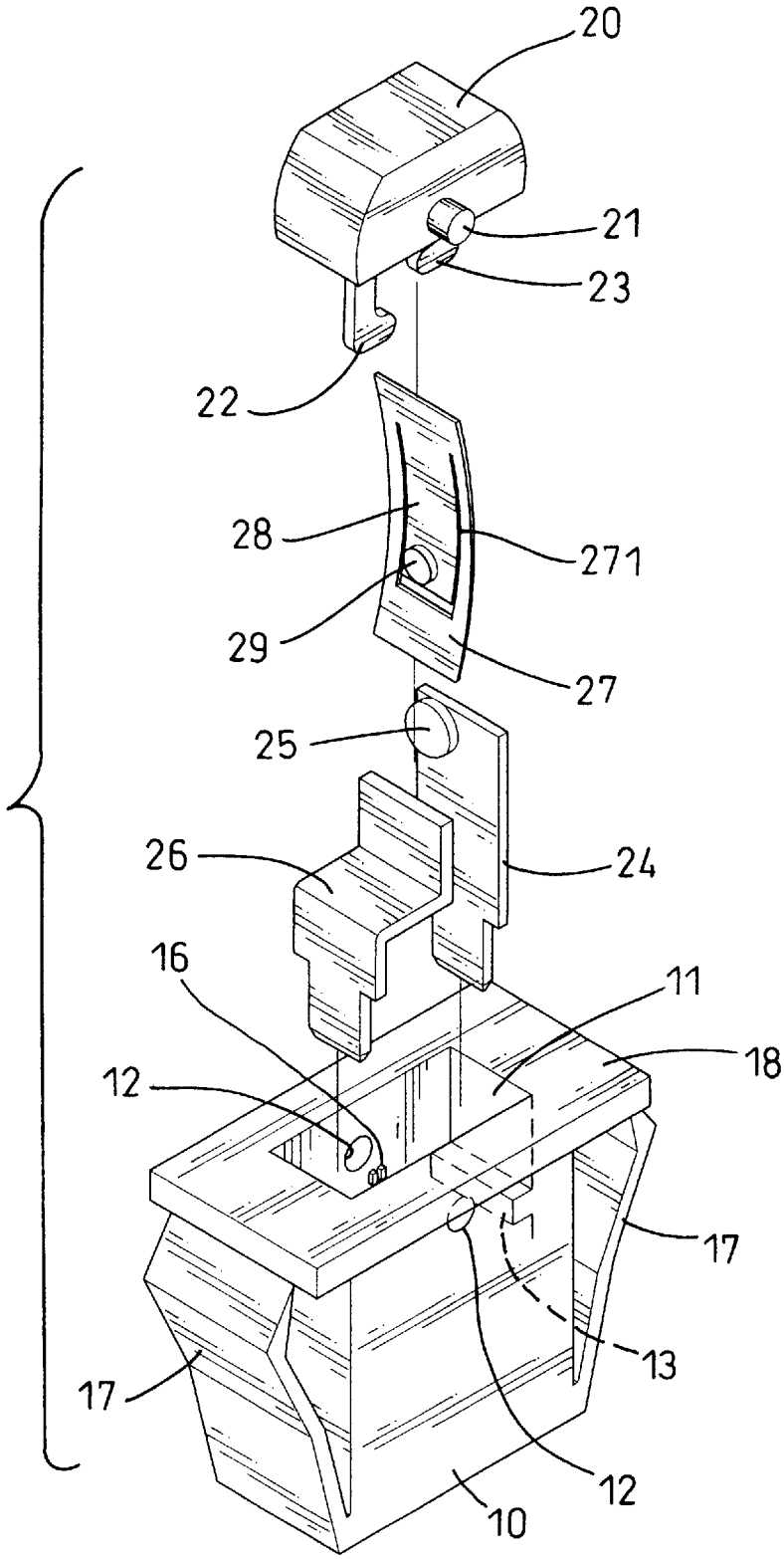
FIG. 1 is an exploded perspective view of a preferred embodiment of a circuit breaker in accordance with the present invention.

Referring to FIG. 1, a circuit breaker in accordance with the present invention includes an integral housing (10) having a rim (18) defining an open top (11), preferably with a pair of clips (17) formed on outer sides of the housing (10). Thus, the housing (10) can easily be got stuck in a porthole defined in a wall by the resilience of the deformed clips (17), which abut opposed sidewalls defining the porthole.

At the open top (11), there is a button (20) having a first leg (22) and a second leg (23). The button (20) is formed with a pair of stubs (21) (only one is shown) which extend into aligned holes (12) defined in opposed walls of the housing (10), and so the button (10) is pivotally connected to the housing (10) about the stubs (21).

The housing (10) further has two opposed inner grips (16) formed on the walls under the holes (12), for the purpose of holding a bimetallic strip (27) in place therein. The bimetallic strip (27), slightly curved, has a U-shaped slit (271) surrounding a downwardly extending tongue portion (28) which is provided with a first contact (29).

Figure 2:
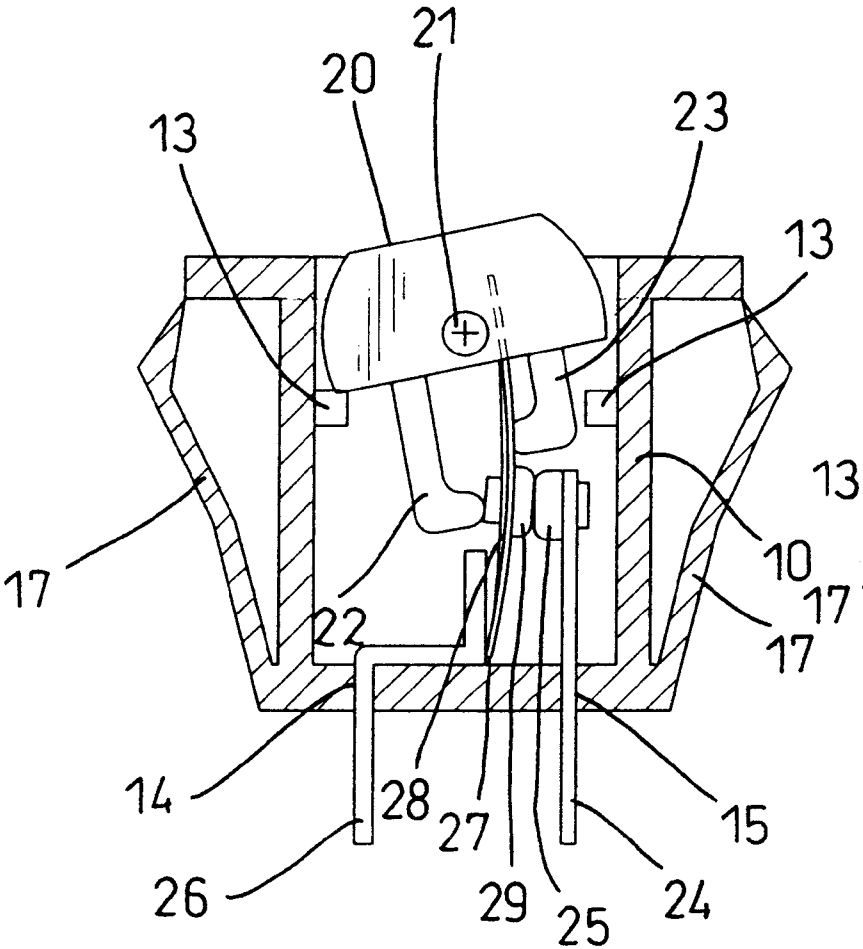
FIG. 2 is a cross-sectional front view of the circuit breaker of FIG. 1 in its switched-on position.
Figure 5:
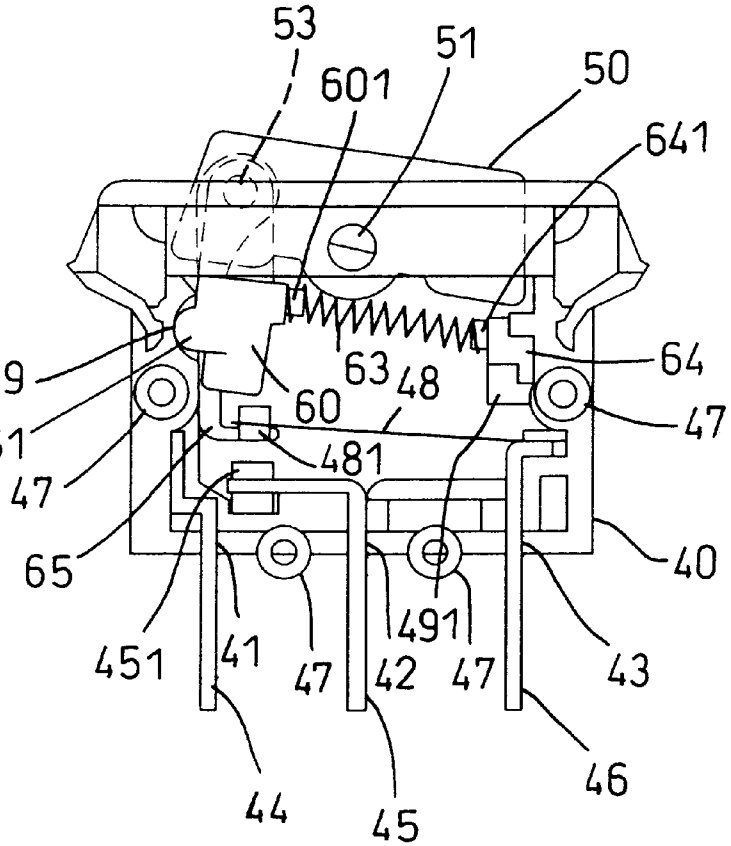
FIG. 5 PRIOR ART
FIG. 5 is a front view of the conventional circuit breaker of FIG. 4 in its switched-off position.
Figure 4:
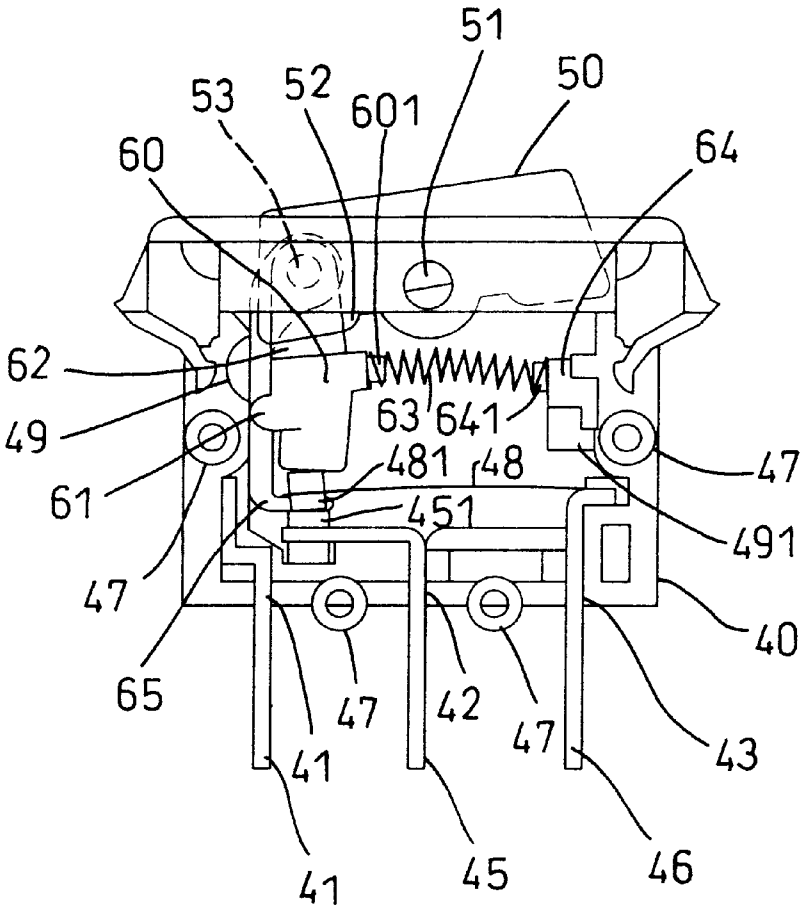
FIG. 4 PRIOR ART
FIG. 4 is a front view of a conventional circuit breaker in its switched-on position.

Referring to FIG. 2, the button (20) is pivotal about the stubs (21) between two extreme positions, which are both defined by a pair of opposite stops (13) formed on inner walls of the housing (10). The legs (22, 23) of the button (10) should be configured so that the tongue portion (28) may be sandwiched between the legs (22, 23) whenever the button (20) is in any position between the two extreme positions.

Additionally, the housing (10) has a closed bottom defining two slots (14, 15), through which a first blade (24) and a second blade (26) extend from the interior to the exterior of the housing (10), respectively.

The first blade (24) has an inner end provided with a second contact (25). The bimetallic strip (27) is engaged at its first contact (29) with the second contact (25) while at its bottom with the second blade (26), thereby connecting the two blades (24, 26) together.

Figure 3:
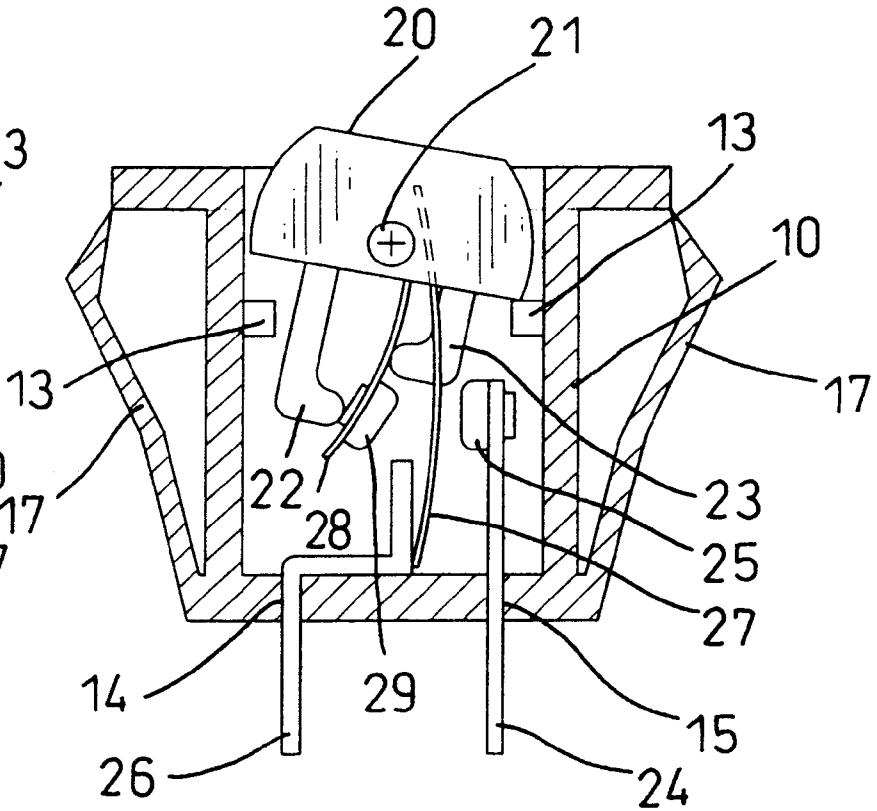
FIG. 3 is a cross-sectional front view of the circuit breaker of FIG. 1 in its switched-off position.

Referring to FIG. 3, the tongue portion (28) of the bimetallic strip (27) becomes hot and curved leftward if an electric overcurrent goes through it as well as the blades (24,

26). Now the tongue portion (28) disengages its first contact (29) from the second contact (25) of the first blade (24), thus stopping the electric current between the blades (24, 26).

Simultaneously, the tongue portion (28) pushes the first leg (22) leftward and turns the button (20) in a clockwise direction, as viewed in FIG. 3. The tongue portion (28) of the bimetallic strip (27) is then retained in this position by the second leg (23) of the button (20) until the button (20) is manually turned in a counterclockwise direction, when the contacts (25, 29) are brought into contact and the blades (24, 26) are connected again.

From the above description, it is noted that the invention has the following advantages:

1. being simple in structure:
   Because no spring and related members are involved, the inventive circuit breaker is simple in its structure.
2. being easy to be assembled:
   Because the housing (10) is formed integrally, no riveting process is required during the assembly of the whole circuit breaker.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A circuit breaker comprising:

a housing (10) having a rim (18) defining an open top (11), said housing (10) being formed with a closed bottom defining two slots (14, 15);

a button (20) pivotally connected to said housing (10) at said open top (11), said button (20) being pivotal relative to said housing (10) between two extreme positions;

a first blade (24) and a second blade (26) both extending from the interior to the exterior of said housing (10) through said slots (14, 15);

a bimetallic strip (27) held in place in said housing (10) and engaged with said second blade (26), said bimetallic strip (27) having a U-shaped slit (271) surrounding a tongue portion (28) of said bimetallic strip (27), said tongue portion (28) normally engaged with said first blade (24); and wherein said button (20) has two legs (22, 23) configured so that said tongue portion (28) of said bimetallic strip (27) may be sandwiched between said legs (22, 23) whenever said button (20) is in any angular position between said two extreme positions.

2. The circuit breaker as claimed in claim 1, wherein said housing (10) has a pair of clips (17) formed on opposed outer sides thereof.

* * * * *